US011378342B2

(12) United States Patent
Anetseder et al.

(10) Patent No.: US 11,378,342 B2
(45) Date of Patent: Jul. 5, 2022

(54) TUBE BUNDLE-TYPE HEAT EXCHANGER, TUBE BASE, AND METHOD FOR SEALING SAME

(71) Applicant: SGL CARBON SE, Wiesbaden (DE)

(72) Inventors: Werner Anetseder, Meitingen (DE); Hermann Ferber, Meitingen (DE); Klaus Baldermann, Meitingen (DE); Ralph Spuller, Meitingen (DE)

(73) Assignee: SGL CARBON SE, Wiesbaden (DE)

( * ) Notice: Subject to any disclaimer, the term of this patent is extended or adjusted under 35 U.S.C. 154(b) by 0 days.

(21) Appl. No.: 16/971,392

(22) PCT Filed: Feb. 27, 2019

(86) PCT No.: PCT/EP2019/054870
§ 371 (c)(1),
(2) Date: Aug. 20, 2020

(87) PCT Pub. No.: WO2019/166493
PCT Pub. Date: Sep. 6, 2019

(65) Prior Publication Data

US 2021/0207892 A1 Jul. 8, 2021

(30) Foreign Application Priority Data

Feb. 28, 2018 (DE) ..... 10 2018 001 548.4

(51) Int. Cl.
*F24H 3/00* (2022.01)
*F28D 7/16* (2006.01)
(Continued)

(52) U.S. Cl.
CPC ..... *F28D 7/16* (2013.01); *F28F 9/0221* (2013.01); *F28F 9/0229* (2013.01);
(Continued)

(58) Field of Classification Search
CPC ..... F28D 7/16; F28F 9/0221; F28F 21/006; F28F 9/0229; F28F 21/02; F28F 21/04; F28F 21/062; F28F 2230/00
(Continued)

(56) References Cited

U.S. PATENT DOCUMENTS

2010/0012296 A1* 1/2010 Cox ..... F28F 9/26 165/104.19
2010/0116478 A1* 5/2010 Wanni ..... F28F 9/0131 165/162

FOREIGN PATENT DOCUMENTS

DE 19714423 C2 5/2003
DE 102010005216 A1 7/2011
(Continued)

OTHER PUBLICATIONS

International Search Report dated May 27, 2019 in corresponding International Application No. PCT/EP2019/054870; 5 pages.

*Primary Examiner* — Davis D Hwu
(74) *Attorney, Agent, or Firm* — Maier & Maier, PLLC

(57) ABSTRACT

A tube bundle-type heat exchanger, to a tube base, and to a method for sealing same. Aspects of the invention relate to a tube base for a tube bundle-type heat exchanger. In particular, the tube base includes a stack of multiple tube base plates with at least one through-opening for receiving a respective tube of the tube bundle-type heat exchanger. The throughopening is sealed by at least one seal ring. Additional aspects relate to a tube bundle-type heat exchanger comprising such a tube base and to a method for sealing a tube bundle-type heat exchanger in particular in the region of the tube base.

20 Claims, 2 Drawing Sheets

(51) Int. Cl.

| | |
|---|---|
| ***F28F 9/02*** | (2006.01) |
| ***F28F 21/00*** | (2006.01) |
| ***F28F 21/02*** | (2006.01) |
| ***F28F 21/04*** | (2006.01) |
| ***F28F 21/06*** | (2006.01) |

(52) U.S. Cl.
CPC ..... *F28F 21/006* (2013.01); *F28F 21/02* (2013.01); *F28F 21/04* (2013.01); *F28F 21/062* (2013.01); *F28F 2230/00* (2013.01)

(58) Field of Classification Search
USPC ..... 165/158
See application file for complete search history.

(56) References Cited

FOREIGN PATENT DOCUMENTS

| | | | |
|---|---|---|---|
| DE | 202004021912 | U1 | 11/2012 |
| DE | 102015114130 | A1 | 3/2017 |
| EP | 1422488 | A2 | 5/2004 |
| EP | 1 491 842 | A2 | 12/2004 |

* cited by examiner

TUBE BUNDLE-TYPE HEAT EXCHANGER, TUBE BASE, AND METHOD FOR SEALING SAME

Aspects of the invention relate to a tube base for a shell-and-tube heat exchanger. The tube base comprises in particular a stack of a plurality of tube base plates with at least one through-opening for receiving a respective tube of the shell-and-tube heat exchanger. The through-opening is sealed by means of at least one sealing ring. Further aspects relate to a shell-and-tube heat exchanger comprising such a tube base and to a method for sealing a shell-and-tube heat exchanger in particular in the region of the tube base.

TECHNICAL BACKGROUND

Heat exchangers for use in highly corrosive environments are typically constructed with tubes made of a corrosion-resistant material such as for example graphite, silicon carbide, glass or PTFE. The tubes contain a first fluid and are surrounded by a second fluid located in an inner housing region, so that a heat exchange between the first and the second fluid can take place through the tube walls. The entry and exit points of the tubes are separated from the inner housing region by a tube base, so that the first fluid entering and exiting cannot mix with the second fluid. Excellent sealing of the tube base is crucial for this.

The tube base of a typical such heat exchanger is typically constructed from one or more tube base plates with a plastics-sheathed metal core. The plastics sheathing may for example comprise a chemically resistant material such as PFA or PTFE, in order to make it possible to use it with corrosive media (first and/or second fluid).

In contrast to heat exchangers made of metal, in which the tubes are connected in a fluid-tight manner to the tube bases by welding and similar methods, this is not possible when using glass or silicon carbide tubes. Instead, the tubes are passed (entirely or in part) through through-openings in the tube base and have to be sealed in complex manner.

For example, DE 197 14 423 C2 discloses a shell-and-tube heat exchanger with tube bases which are divided into two parts and made of plastics material with a metal plate laid therein. Therein, tubes arranged in bores are sealed in between the individual tube bases in each case with the aid of an O-ring. However, with such heat exchangers the sealing action may lessen after some time. Therefore it is desirable to improve the sealing action.

As a further example, DE 10 2010 005216 A1 discloses a shell-and-tube heat exchanger with tube bases which are divided into two parts and made of plastics material, between which an intermediate plate is arranged. Compound sleeves can be inserted into the through-bores in the intermediate plate.

Solutions which are already known have the disadvantage that they require high complexity in design terms and yet the long-term stability of the seal is not always guaranteed.

SUMMARY OF THE INVENTION

Therefore it is an object of the invention to make possible a shell-and-tube heat exchanger in which at least some of the above-mentioned disadvantages are reduced. In particular, as simple a design as possible with as reliable a sealing action as possible should be made possible.

According to one aspect of the invention, a tube base for a shell-and-tube heat exchanger is made available. The tube base comprises a first tube base plate with a core and plastics sheathing surrounding the core, a second tube base plate made of a temperature-resistant material (for example a graphite or ceramic plate), and a third tube base plate with a core and plastics sheathing surrounding the core.

The first, second and third tube base plate are stacked to form a stack, wherein the second tube base plate is arranged as an intermediate plate between the first and the third tube base plate (20, 40), so that a first surface of the second tube base plate is directed towards the first tube base plate and an opposite second surface of the second tube base plate is directed towards the third tube base plate.

The stack has at least one through-opening for receiving a respective tube of the shell-and-tube heat exchanger. The tube base further has for each of the at least one through-openings: at least one sealing ring each for sealing the respective tube, and at least one seal seat each for receiving the at least one sealing ring, wherein the seal seat is an indentation in the second tube base plate which surrounds the respective through-opening directly in ring-like manner.

Aspects of the invention have the advantage that a second tube base plate made of a temperature-resistant material is made available, and that a seal seat for receiving the sealing ring is set therein. Such a seal seat makes reliable and long-term stable sealing of the tube base plate possible.

Additionally, the second tube base plate is arranged in a stack between two plastics-sheathed tube base plates (first and third tube base plate) and is protected thereby against mechanical loading. Due to this arrangement, the stability of the tube base is increased further. Due to this arrangement as a stack, in particular a tube base which combines the advantageous properties of the respective tube base plates can be made available.

Since the second tube base plate as a whole is constructed from a temperature-resistant material and preferably consists of the temperature-resistant material, the reliability of the seal seat is increased still further. Further, a particularly simple structure of the tube base can be achieved as a result.

DESCRIPTION OF FURTHER ASPECTS OF THE INVENTION

Further, preferred (i.e. optional), aspects of the invention will be described below. Reference numerals refer for illustration to the drawings described more precisely following this, but do not restrict the aspects to the embodiments illustrated therein. Unless otherwise indicated, any aspect may be combined with any other aspect described herein or any other embodiment described herein.

According to one aspect, the temperature-resistant material of the second tube base plate is defined in that the material has no substantial flow behaviour for temperatures up to at least 250° C. For plastics materials, this condition is defined by a temperature of deflection of greater than 250° C., the temperature of deflection being determined to DIN EN ISO 75-2:2013 (under a load of 0.45 MPa according to method B). Conventional plastics materials such as PFA or PTFE do not meet this condition. One exception for which the temperature of deflection is greater than 250° C. is the plastics material PEEK. Plastics materials which are highly filled with dimensionally stable fillers may also meet the condition. The above criterion applies analogously to non-plastics materials. In this case, steel, ceramic, graphite, glass and further materials with similarly low flow properties at 250° C. are always to be regarded as temperature-resistant, regardless of the above condition. More preferably, the material of the second tube base plate is a ceramic.

According to one further aspect, the temperature-resistant material of the second tube base plate is therefore selected from the materials steel, ceramic, glass, plastics material with a temperature of deflection of greater than 250° C. as defined above, in particular PEEK, and a mixture thereof (for example as a composite material).

According to one further aspect, the material of the second tube base plate has a thermal linear expansion a of <20 μm/mK for any temperatures between −50° C. and 200° C. This ensures a reliable seal seat even in the event of temperature fluctuations.

According to one further aspect, the material of the second tube base plate has a modulus of elasticity of >300 GPa. This ensures good flexural strength of the second tube base plate.

According to one further aspect, the core (22, 42) of the first and/or the third tube base plate in each case comprises at least one of a metal (for example a metal alloy) and a fibre-composite material, or consists thereof. The fibre-composite material may for example be a carbon-based fibre-composite material such as for example CFRP and/or CFC. The plastics sheathing (24, 44) of the first and/or the third tube base plate may in each case comprise at least one fluoropolymer such as for example PFA and/or PTFE. The plastics sheathing (24, 44) according to one aspect is made not or of an only limitedly temperature-resistant material (for example does not meet the above definition of a temperature-resistant material).

According to one further aspect, the first and third tube base plate (20, 40) are of identical construction, as a result of which the number of different parts can be reduced.

According to one further aspect, the second tube base plate (30) is a graphite or ceramic plate, with the ceramic preferably being a non-oxide ceramic such as for example SSiC, SiSiC, and/or SN. The second tube base plate may comprise the graphite or the ceramic or consist thereof. Advantages of these materials are their temperature resistance together with simultaneous corrosion resistance, and also advantageous mechanical properties when stacked.

According to one further aspect, the at least one through-opening (14) is a plurality of through-openings. According to one further aspect, the second tube base plate (30) is of one piece, so that the same monolithic material of the second tube base plate (30), for example graphite or ceramic, adjoins the plurality of through-openings (14).

According to one further aspect, the at least one seal seat (34, 38, 39) and/or the at least one sealing ring (52) is designed with a cross section which is rectangular (in particular square), trapezoidal, conical, cone-shaped, or oval in portions. The cross section of the seal seat may in such case be open towards an inner side of the respective through-opening (14). Further, one side of the seal seat may be formed by a surface portion of the first or the third tube base plate respectively. According to one portion, at least two sides of the seal seat are formed by an (indented) surface portion of the second tube base plate.

According to one further aspect, each at least one sealing ring (52) is at least two sealing rings. Thus each at least one seal seat (34, 38) comprises at least a first and a second seal seat. The first seal seat (34) may for example be arranged as an indentation in the first surface (32) of the second tube base plate (30), and the second seal seat (38) may be arranged as an indentation in the second surface (36) of the second tube base plate (30).

According to one further aspect, the sealing rings (52) in the respective seal seat (34, 38) are pressed in between the second and the first tube base plate (30, 20) or the second and the third tube base plate (30, 40) respectively in such a way that the sealing rings contact the respective plastics sheathing (24, 44) on at most one side, but preferably contact the material of the second tube base plate on at least two sides (one side of which is the side opposite the through-opening).

According to one further aspect, the seal seat (39) is arranged as an indentation in a side wall of the through-opening (14), spaced apart from the first and second surface (32, 36) of the second tube base plate (30).

According to one further aspect, the first, second and third tube base plate (20, 30, 40) are pressed against each other by wedging, for example by a flange and/or a through bolt. Preferably, the force for pressing the tube base plates against each other is introduced exclusively from an edge region of the tube base plates (20, 30, 40), for example by a flange. Otherwise, the tube base plates (20, 30, 40) are preferably mechanically decoupled. A sufficient clamping action can be imparted by the rigidity of the second tube base plate.

According to one further aspect, a shell-and-tube heat exchanger (1) with the tube base (10) described herein is made available. The shell-and-tube heat exchanger (1) comprises for each of the at least one through-opening(s) (14) a tube (50) which passes completely or partially (at least up to the second tube base plate) through the respective through-opening and which is sealed in by means of the at least one seal ring (52) lying in the at least one seal seats (34, 38, 39). This does not rule out the presence of further through-openings (for example for through bolts).

According to one further aspect, the tube (50) is a graphite, SiC or glass tube, i.e. comprises these materials or consists thereof.

According to one further aspect, the shell-and-tube heat exchanger is provided for a strongly corrosive medium (for example strong acids such as hydrofluoric acid (HF), hydrochloric acid (HCl), nitric acid ($HNO_3$), or alternatively strong lyes). The plastics sheathing (24, 44) is chemically resistant to the corrosive medium.

According to one further aspect, a method for sealing a shell-and-tube heat exchanger (1) is proposed. The method comprises the following steps: a tube base (10) is made available; and at least one tube (50) of the shell-and-tube heat exchanger is passed through the corresponding through-opening (14) and sealed in by means of the at least one seal ring (52) lying in the at least one seal seat (34, 38, 39). The method may be part of a production method for the shell-and-tube heat exchanger or of a maintenance or repair method for the shell-and-tube heat exchanger.

BRIEF DESCRIPTION OF THE DRAWINGS

Hereinafter, the invention will be discussed with reference to embodiments illustrated in drawings, from which further advantages and modifications will become apparent, and in which.

DETAILED DESCRIPTION OF EMBODIMENTS OF THE INVENTION

Figure 1:
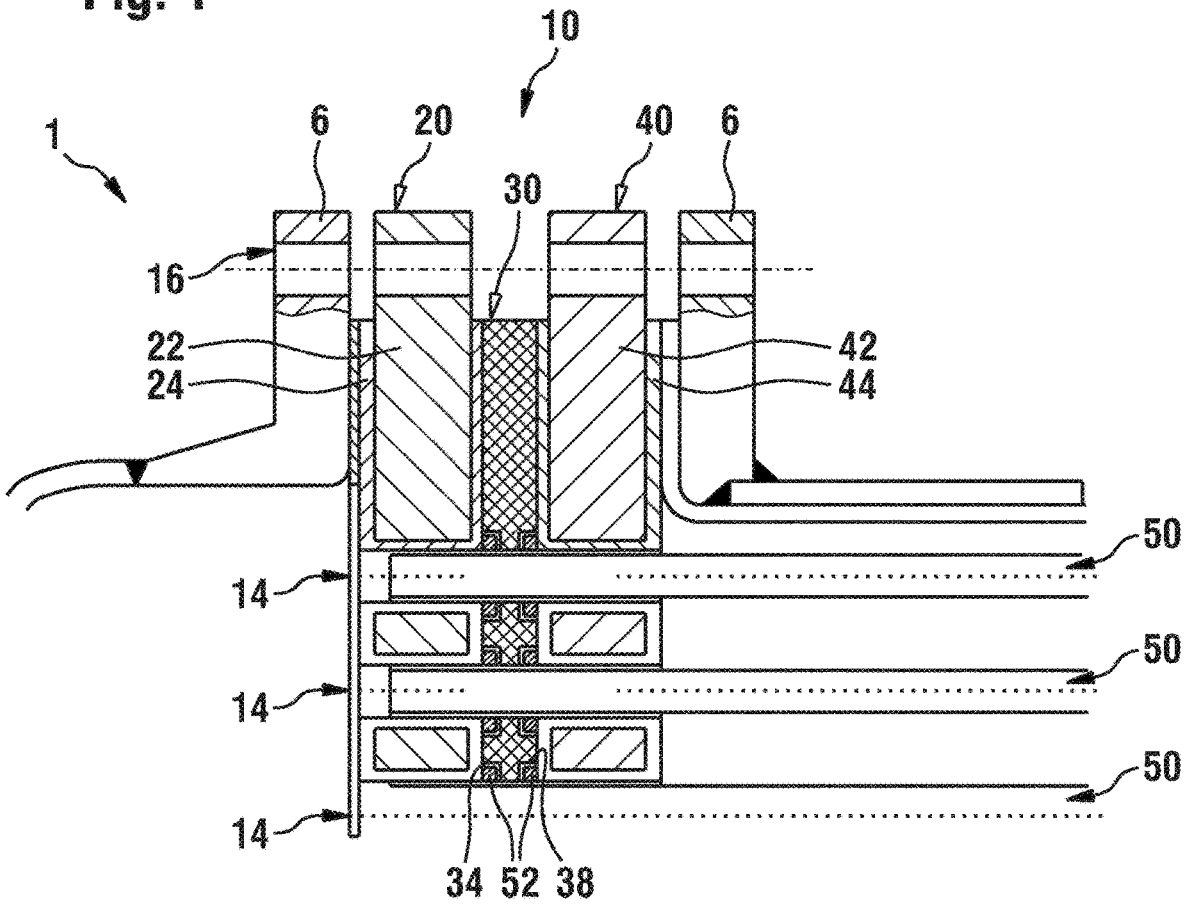
FIG. 1 is a cross-sectional view of a shell-and-tube heat exchanger with a tube base according to one embodiment of the invention.

With reference to FIG. 1, a shell-and-tube heat exchanger 1 according to one embodiment of the invention is described below. The shell-and-tube heat exchanger 1 has a housing 6, a tube base 10 with through-openings 14, and tubes 50 which pass through the respective through-openings 14.

In operation, the tubes 50 contain a first fluid and are surrounded by a second fluid located in an inner housing region (to the right of the tube base 10 in FIG. 1), so that a heat exchange between the first and the second fluid can take place through the tube walls. The entry and exit points of the tubes 50 (to the left-hand side of the tube base 10 in FIG. 1) are separated by the tube base 10 from the inner housing region to the right of the tube base 10 and are sealed therein as described below.

The tube base 10 comprises a first tube base plate 20 with a core 22 and plastics sheathing 24 surrounding the core, a second tube base plate 30 made of the temperature-resistant material already described above, and a third tube base plate 40 with a core 42 and plastics sheathing 44 surrounding the core.

The three tube base plates 20, 30, 40 are stacked to form a stack, in which the second tube base plate 30 is arranged as an intermediate plate between the first and the third tube base plate 20, 40. In other words, the first surface 32 of the second tube base plate is directed towards the first tube base plate 20 and the opposite second surface 36 of the second tube base plate is directed towards the third tube base plate 40.

In each of the through-openings 14 there are formed two seal seats 34, 38, with in each case one sealing ring 52 received therein, in order to seal the respective tube 50. More precisely, the seal seats 34, 38 are designed one as indentations in the second tube base plate 30, which surrounds the through-opening 14 directly in ring-like manner. The rear face located opposite the through-opening 14 and a lateral face of the seal seats 34, 38 are formed by the second tube base plate 30, and a further lateral face of the seal seats 34, 38 is formed by the first or third tube base plate 20, 40 respectively, more precisely by the plastics sheathing 24, 44 thereof.

Due to the fact that the seal seats 34, 38 are designed one as indentations in the second, temperature-stable, tube base plate 30, a stable and reliable sealing action is made possible.

The three tube base plates 20, 30 and 40 are pressed against each other by a pair of flanges of the housing 6 and thus wedged together. The wedging takes place by means of a bracing element, not shown (for example a tension element such as a screw), which is passed through the flanges and through the stack of tube base plates 20, 30 and 40 in order to press the flanges against each other and thus to compress the stack. The bracing element here extends through a flange through-opening 16 which passes through the flanges and through the stack of the three tube base plates 20, 30 and 40.

The bracing elements are arranged exclusively in the edge region (flange region) of the tube base. In the interior of the housing 6, the tube base plates 20, 30, 40 are mechanically decoupled, however. Owing to the resistance to bending of the tube base, in particular of the second tube base plate 30, it is possible to dispense with bracing elements or connecting elements located further to the inside, and yet it can be ensured that the tube base plates 20, 30, 40 are pressed sufficiently against one another.

Figure 2:
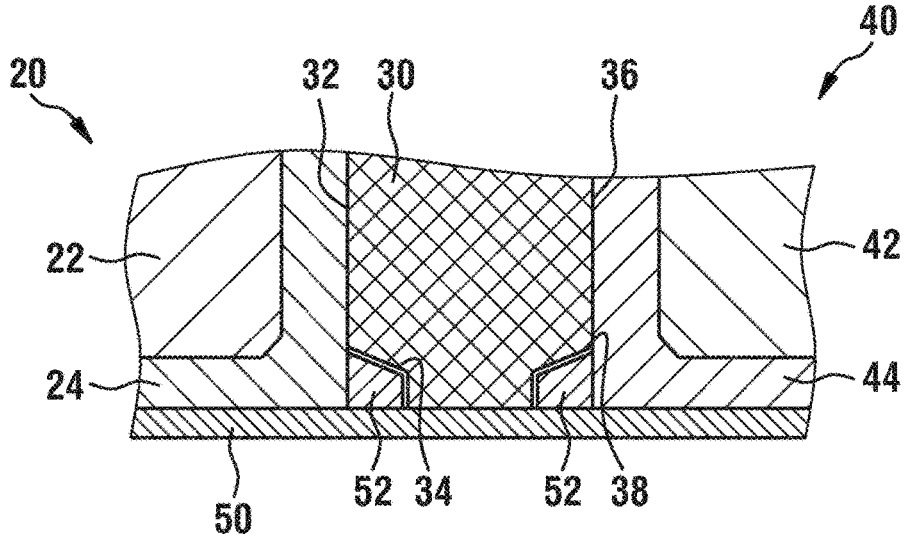
FIG. 2 is an enlarged cross-sectional view of a tube base according to a further embodiment of the invention.

FIG. 2 is an enlarged cross-sectional view of a tube base according to a further embodiment of the invention. This embodiment largely corresponds to the embodiment of FIG. 1, and the description of FIG. 1 correspondingly applies here as well.

Merely the cross-sectional shape of the seal rings 52 and of the associated seal seats 34, 38 differs. In FIG. 1, the seal rings 52 and the seal seats 34, 38 have a rectangular (square) cross section, and in FIG. 2 they have a trapezoidal cross section. Further cross sections described above are also possible.

Figure 3:
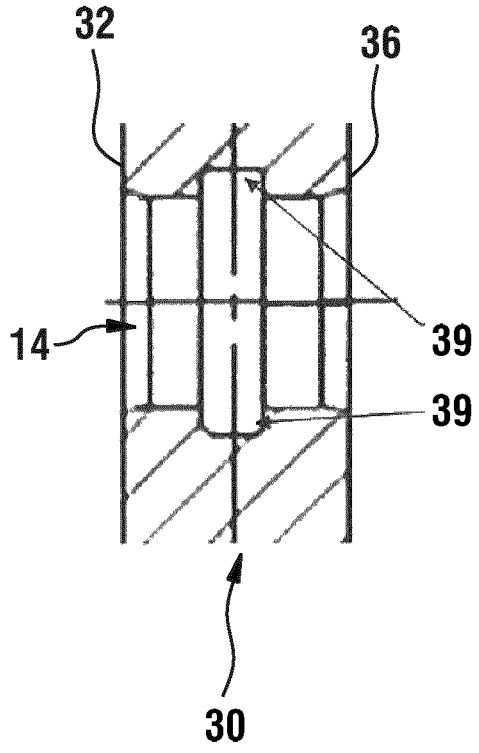
FIG. 3 is a cross-sectional view of the second tube base plate of a tube base according to a further embodiment of the invention.

FIG. 3 is a cross-sectional view of the second tube base plate 30 of a tube base according to a further embodiment of the invention. Apart from the illustrated configuration of the second tube base plate 30 (and in particular apart from the seal seat and the associated seal rings), the embodiment corresponds to the structure illustrated in FIG. 1.

In the second tube base plate 30 of FIG. 4, instead of the two seal seats 34, 38 illustrated in FIGS. 1-3 only a single seal seat 39 is formed. The seal seat 39 is formed on the side wall of the through-opening 14 in an axially central portion of the second tube base plate 30 and is thus spaced apart from the first and third tube base plate. Thus, in FIG. 4, only a single seal ring per through-opening is provided. All the sides of the seal seat 39 are formed by the heat-resistant material of the second tube base plate 30.

Unless otherwise illustrated, the embodiments of FIGS. 1-4 may have all the further aspects described above. The embodiments and aspects serve merely for illustration and are not intended to restrict the scope of protection. The scope of protection is defined by the disclosure.

The invention claimed is:

1. A tube base for a shell-and-tube heat exchanger, the tube base comprising:

a first tube base plate with a core and plastics sheathing surrounding the core, a second tube base plate made of a temperature-resistant material, wherein the temperature-resistant material has no substantial flow behaviour for temperatures up to at least 200° C. and no substantial thermal expansion for temperatures between −50° C. and 200° C., and a third tube base plate with a core and plastics sheathing surrounding the core, wherein the first, second and third tube base plates are stacked to form a stack, wherein the second tube base plate is arranged as an intermediate plate between the first and the third tube base plate, so that a first surface of the second tube base plate is directed towards the first tube base plate and an opposite second surface of the second tube base plate is directed towards the third tube base plate, and wherein the stack comprises at least one through-opening for receiving a respective tube of the shell-and-tube heat exchanger, and wherein the tube base further has, for each of the at least one through-opening(s) with at least one sealing ring each for sealing the respective tube, at least one seal seat each for receiving the at least one sealing ring wherein the seal seat is an indentation in the second tube base plate which surrounds the respective through-opening directly in ring-like manner.

2. The tube base for a shell-and-tube heat exchanger according to claim 1, wherein the core of the first and/or the third tube base plate in each case comprises at least one of a metal and a fibre-composite material.

3. The tube base for a shell-and-tube heat exchanger according to claim 1, wherein the first and third tube base plate are of identical construction.

4. The tube base for a shell-and-tube heat exchanger according to claim 1, wherein the second tube base plate is a graphite or ceramic plate.

5. The tube base for a shell-and-tube heat exchanger according to claim 1, wherein the at least one through-opening is a plurality of through-openings, and wherein the second tube base plate is of one piece, so that the same monolithic material of the second tube base plate adjoins the plurality of through-openings.

6. The tube base for a shell-and-tube heat exchanger according to claim 1, wherein the at least one sealing ring is designed with a cross section which is rectangular, trapezoidal, conical, cone-shaped, or oval in portions.

7. The tube base for a shell-and-tube heat exchanger according to claim 1, wherein each at least one sealing ring is at least two sealing rings, and wherein each at least one seal seat comprises at least a first and a second seal seat, wherein the first seal seat is arranged as an indentation in the first surface of the second tube base plate and the second seal seat is arranged as an indentation in the second surface of the second tube base plate.

8. The tube base for a shell-and-tube heat exchanger according to claim 1, wherein the sealing rings in the respective seal seat are pressed in between the second and the first tube base plate or the second and the third tube base plate respectively in such a way that the sealing rings contact the respective plastics sheathing on at most one side.

9. The tube base for a shell-and-tube heat exchanger according to claim 1, wherein the seal seat is arranged as an indentation in a side wall of the through-opening, spaced apart from the first and second surface of the second tube base plate.

10. The tube base for a shell-and-tube heat exchanger according to claim 1, wherein the first, second and third tube base plate are pressed against each other by wedging.

11. A shell-and-tube heat exchanger, comprising:

a tube base including a first tube base plate with a core and plastics sheathing surrounding the core, a second tube base plate made of a temperature-resistant material, wherein the temperature-resistant material has no substantial flow behaviour for temperatures up to at least 200° C. and no substantial thermal expansion for temperatures between −50° C. and 200° C., and a third tube base plate with a core and plastics sheathing surrounding the core, wherein the first, second and third tube base plates are stacked to form a stack, wherein the second tube base plate is arranged as an intermediate plate between the first and the third tube base plate, so that a first surface of the second tube base plate is directed towards the first tube base plate and an opposite second surface of the second tube base plate is directed towards the third tube base plate, and wherein the stack comprises at least one through-opening for receiving a respective tube of the shell-and-tube heat exchanger, and wherein the tube base further has, for each of the at least one through-opening(s) with at least one sealing ring each for sealing the respective tube, at least one seal seat each for receiving the at least one sealing ring wherein the seal seat is an indentation in the second tube base plate which surrounds the respective through-opening directly in ring-like manner and for each of the at least one through-openings a tube which passes through the respective through-opening and is sealed in by the at least one seal ring lying in the at least one seal seat.

12. The shell-and-tube heat exchanger according to claim 11, wherein the tube is a graphite, SiC or glass tube.

13. The shell-and-tube heat exchanger according to claim 11, wherein the shell-and-tube heat exchanger is provided for a corrosive medium and wherein the plastics sheathing is chemically resistant to the corrosive medium.

14. A method for sealing a shell-and-tube heat exchanger, the method comprising:

a tube base including a first tube base plate with a core and plastics sheathing surrounding the core, a second tube base plate made of a temperature-resistant material, wherein the temperature-resistant material has no substantial flow behaviour for temperatures up to at least 200° C. and no substantial thermal expansion for temperatures between −50° C. and 200° C., and a third tube base plate with a core and plastics sheathing surrounding the core, wherein the first, second and third tube base plates are stacked to form a stack, wherein the second tube base plate is arranged as an intermediate plate between the first and the third tube base plate, so that a first surface of the second tube base plate is directed towards the first tube base plate and an opposite second surface of the second tube base plate is directed towards the third tube base plate, and wherein the stack comprises at least one through-opening for receiving a respective tube of the shell-and-tube heat exchanger, and wherein the tube base further has, for each of the at least one through-opening(s) with at least one sealing ring each for sealing the respective tube, at least one seal seat each for receiving the at least one sealing ring wherein the seal seat is an indentation in the second tube base plate which surrounds the respective through-opening directly in ring-like manner, at least one tube of the shell-and-tube heat exchanger being passed through the corresponding through-opening and sealed in by means of the at least one seal ring lying in the at least one seal seat.

15. The shell-and-tube heat exchanger according to claim 12, wherein the shell-and-tube heat exchanger is provided for a corrosive medium and wherein the plastics sheathing is chemically resistant to the corrosive medium.

16. The tube base for a shell-and-tube heat exchanger according to claim 2, wherein the first and third tube base plate are of identical construction.

17. The tube base for a shell-and-tube heat exchanger according to claim 2, wherein the second tube base plate is a graphite or ceramic plate.

18. The tube base for a shell-and-tube heat exchanger according to claim 3, wherein the second tube base plate is a graphite or ceramic plate.

19. The tube base for a shell-and-tube heat exchanger according to claim 2, wherein the at least one through-opening is a plurality of through-openings, and wherein the second tube base plate is of one piece, so that the same monolithic material of the second tube base plate adjoins the plurality of through-openings.

20. The tube base for a shell-and-tube heat exchanger according to claim 3, wherein the at least one through-opening is a plurality of through-openings, and wherein the second tube base plate is of one piece, so that the same monolithic material of the second tube base plate adjoins the plurality of through-openings.

* * * * *